US006516488B1

(12) United States Patent
Cados

(10) Patent No.: US 6,516,488 B1
(45) Date of Patent: Feb. 11, 2003

(54) SURFACE SWEEPING DEVICE

(76) Inventor: Dimitri Cados, 10 Hall Dr., Orinda, CA (US) 94563

( * ) Notice: Subject to any disclaimer, the term of this patent is extended or adjusted under 35 U.S.C. 154(b) by 251 days.

(21) Appl. No.: 09/659,139

(22) Filed: Sep. 11, 2000

(51) Int. Cl.[7] ..... A47L 11/24
(52) U.S. Cl. ..... 15/52.2; 15/81
(58) Field of Search ..... 15/52.2, 81

(56) References Cited

U.S. PATENT DOCUMENTS

| | | | |
|---|---|---|---|
| 61,664 A | | 1/1867 | Irion |
| 526,315 A | | 9/1894 | Head |
| 771,787 A | * | 10/1904 | Meyer |
| 870,633 A | | 11/1907 | Lewis |
| 1,197,915 A | | 9/1916 | Dance |
| 5,319,819 A | | 6/1994 | Yoshizawa |
| 5,425,153 A | | 6/1995 | Vosbikian |

* cited by examiner

*Primary Examiner*—Randall E. Chin
(74) *Attorney, Agent, or Firm*—Theodore J. Bielen, Jr.

(57) ABSTRACT

A surface sweeping device utilizing a brush connected to an arm first end portion. The second end portion of the arm connects to a shaft rotated by a motor. The arm contacts a cam surface during a portion of the rotation of the crank to raise and lower the brush from the surface. At the same time, the crank moves the brush inwardly and outwardly to create a sweeping motion.

14 Claims, 3 Drawing Sheets

SURFACE SWEEPING DEVICE

BACKGROUND OF THE INVENTION

The present invention relates to a novel and useful surface sweeping device.

Floor surfaces have been cleaned of debris by the use of brooms, mops, vacuum cleaners, and the like. Mechanized brooms and mops require a great effort to clean surfaces thoroughly. Vacuum cleaners are capable of removing finer particles but create aerosols unless specialized filters are employed. In addition, vacuums are not capable of removing larger particles such as nuts and bolts, pebbles, and the like. Finally, vacuums require bags which must be emptied and replaced after short-periods of time.

Mechanized sweeping and scrubbing devices have been employed to move a brush or broom in a reciprocal fashion across a surface. For example, U.S. Pat. Nos. 61,664, 526,315, and 870,633 show floor cleaning machines which move a brush back and forth on the floor surface by the use of a rotary mechanism.

U.S. Pat. No. 1,197,915 shows a reciprocating brush which is used in conjunction with a vacuum cleaner.

U.S. Pat. No. 5,425,153 shows a broom and dustpan combination in which the broom is clamped to the handle of the dustpan.

U.S. Pat. No. 5,319,819 describes a desktop cleaner using a pair of brushes to sweep dust into a pan within the mechanism through the use of a rotating crankshaft.

A surface sweeping device which is capable of cleaning a surface using a mechanized brush, would be a notable advance in the maintenance field.

BRIEF SUMMARY OF THE INVENTION

In accordance with the present invention a novel and useful surface sweeping device is herein provided.

The sweeping device of the present invention utilizes a brush. The brush may include bristles which can be selected to possess any softness or hardness, as desired. The brush may also be formed into two sections pivotally connected to one another allow the brush to at least partially collapse when used next to a vertical surface such as a wall.

An arm is also employed in the present invention. The arm may be formed of any rigid or semi rigid material and include a first end portion and a second end portion. The first end portion of the arm is connected to the brush. In a certain sense, the combination of the brush and arm may be considered to be a broom.

A rotating shaft is also found in the present invention. The shaft is generally rotated by a motor which may be operated through a source of power such as, electrical, internal combustion, and the like. A crank possessing first and second end portions is also used in the device of the present invention. The crank first portion connects to a rotating shaft for movement with the same. The second end portion of the crank is rotatably connected to the second end portion of the arm. Thus, when the crank rotates, the brush is moved along the surface.

A cam surface is also employed in the present invention in conjunction with the arm. The arm contacts the cam surface during a portion of the rotation of the crank to raise the brush from the surface and lower it again during another portion of the rotation of the crank. In combination with the movement along the surface, the brush assumes a sweeping action. In other words, brush is lifted from the surface and subsequently brought down on the surface in combination with a horizontal movement.

It may be apparent that a novel and useful surface sweeping device has been hereinabove described.

It is therefore an object of the present invention to provide a surface sweeping device which very closely resembles sweeping action of a broom operated manually through a motorized mechanism.

Another object of the present invention is to provide a surface sweeping device which is capable of sweeping immediately adjacent vertical surfaces such as walls, furniture, and the like.

A further object of the present invention is to provide a surface sweeping device which does not require bags to gather debris.

Another object of the present invention is to provide a surface sweeping device which is capable of gathering small and large particles and objects into a pan for disposal.

Another object of the present invention is to provide a surface sweeping device which is capable of operating a brush or broom in a sweeping mechanism which may be moved forwardly or in reverse.

Yet another object of the present invention is to provide a surface sweeping device which is compact and versatile in use.

The invention possesses other objects and advantages especially as concerns particular characteristics and features thereof which will become apparent as the specification continues.

For a better understanding of the invention reference is made to the following detailed description of the preferred embodiments thereof which should be referenced to the prior described drawings.

DETAILED DESCRIPTION OF THE PREFERRED EMBODIMENTS OF THE INVENTION

Various aspects of the present invention will evolve from the following detailed description of the preferred embodiments thereof which should be taken in conjunction with the hereinabove described drawings.

Figure 1:
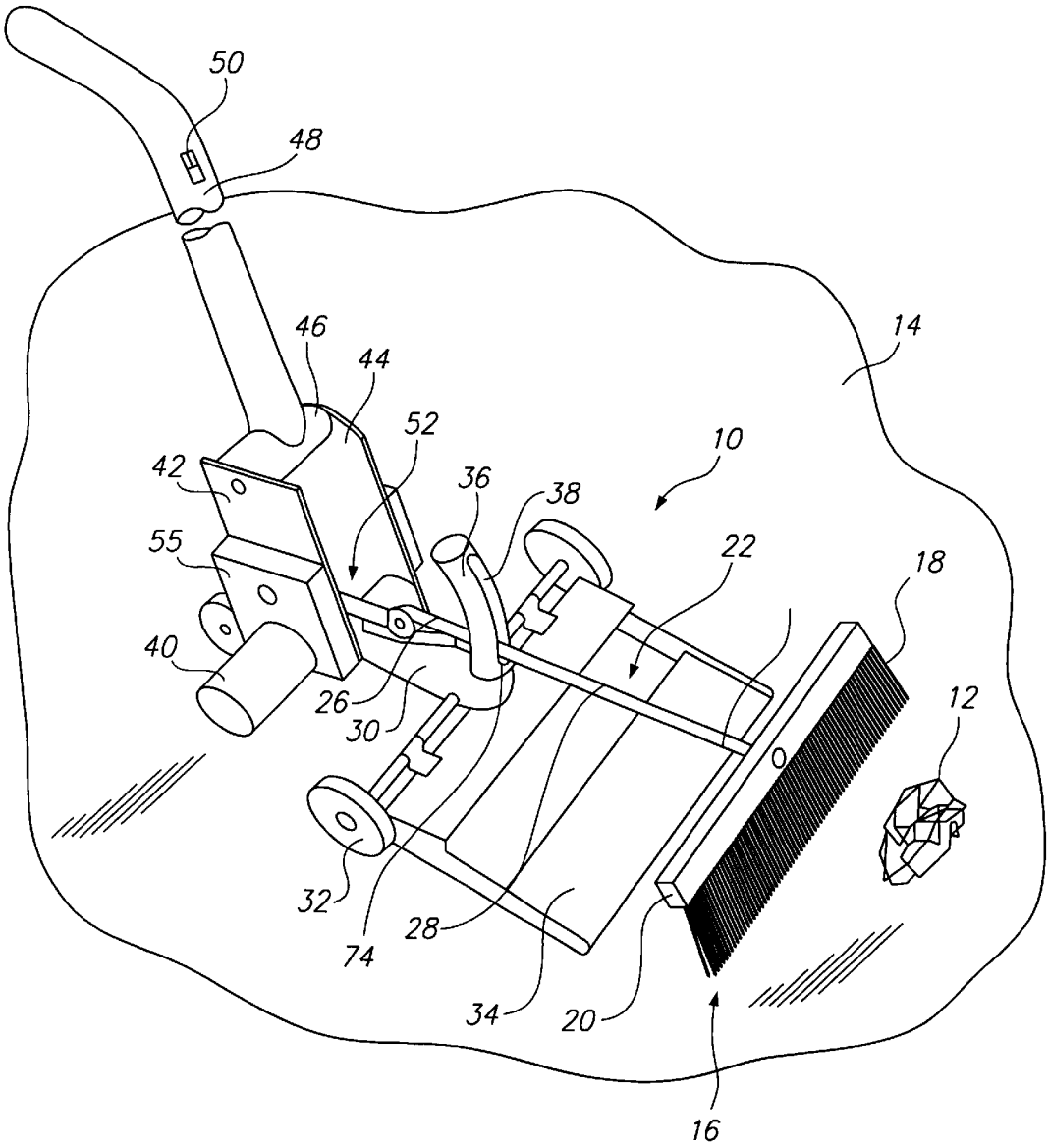
FIG. 1 is a top, front, left side perspective view of the device of the present invention.

The invention as a whole is depicted in the drawings by reference character 10. Surface sweeping device 10 is employed to clean debris 12 from a surface 14, FIG. 1. In this regard, device 10 includes as one of its elements a brush 16 having a plurality of bristles 18 depending from a head or base 20. It should be realized, that brush 16 may take a variety of sizes and types, especially with respect to the stiffness or softness of the bristles. An arm 22 is also found in device 10 and includes a first end portion 24 and a second end portion 26. The intermediate portion 28 spans first and second end portions 24 and 26, respectively. Arm 28 may be constructed of any rigid or semi rigid material such as metal, wood, composite plastics, and the like.

Platform 30 serves as a support for wheel and axle mechanism 32 and dustpan 34. Flange 36 extends upwardly from platform 30 and includes a slot 38 through which arm 22 passes, the importance of which will be discussed in detail hereinafter. Platform 30 also serves as a base for reversible motor 40, (of conventional configuration) and plates 42 and 44, which support crosspiece 46. Handle 48 is fixed to crosspiece 46 and extends upwardly. An electrical switch 50 operates motor 40 in a forward and reverse direction, as well as for the purpose of activating and deactivating motor 40. Arm 22 second end portion 26 is rotatably fixed to a crank 52 through pivot 54.

Figure 2:
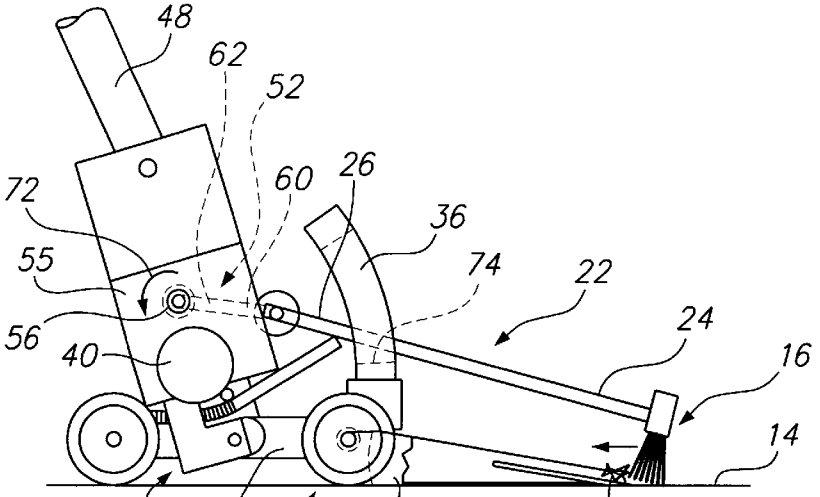
FIG. 2 is a partial side elevational view showing sweeping action of the present invention in which the brush is pulled toward the pan.

Turning to FIG. 2, it may be further observed that motor 40 operates a gearbox 55 which turns a shaft 56. Gearbox 55 is supported to platform 30 by the use of L-shaped arms 58, one of which is depicted in FIGS. 2–6.

Crank 52 includes a first portion 60, pivotally connected to second portion 26 of arm 22, and a second portion 62 fixed to rotating shaft 56. The rotation of crank 52 about shaft 56 as a result of the turning of motor 40 through gearbox 55, creates a sweeping action depicted in FIGS. 2–6, which will be described in detail hereinafter. Spring 69, connected to arm 22 and platform 30 biases second end portion 26 of arm 22 downwardly during the operation of device 10.

Figure 7:
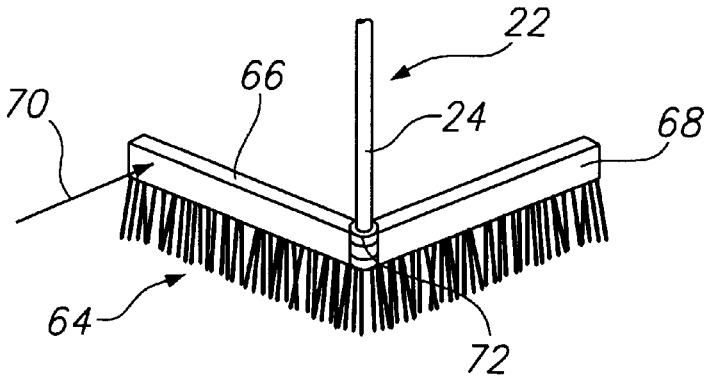
FIG. 7 is a top front perspective view showing a two-part pivoting brush embodiment.

With reference to FIG. 7, a brush 64 is shown in which a first portion 66 pivots relative to second portion 68 is a force is applied. Force arrow 70 depicts a force on the first portion 66 of brush 64 which may be due to contact with a wall, a piece of furniture, and the like. In this manner, brush 64 is able to partially "collapse", or swing, when such contact is made. In addition, pivot 72 may be spring loaded such that brush portion 66 and 68 are capable of flicking debris forward when arm is extended outwardly from motor 40.

Figure 3:
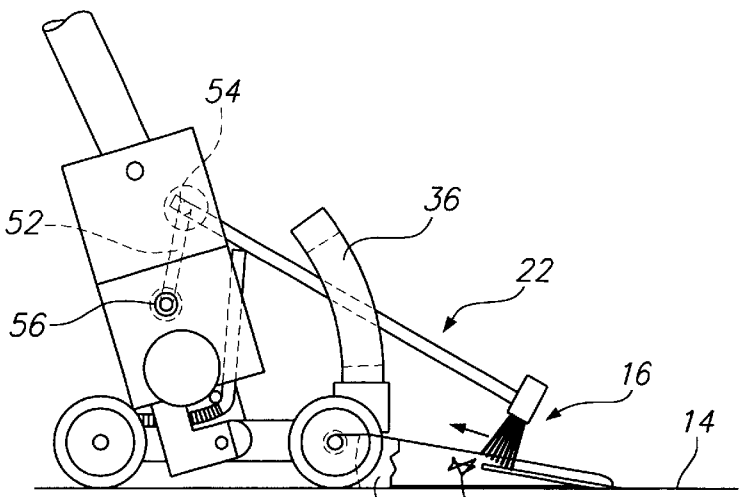
FIG. 3 is a partial side elevational view of the present invention showing the sweeping action in which the brush has been pulled onto the pan.
Figure 5:
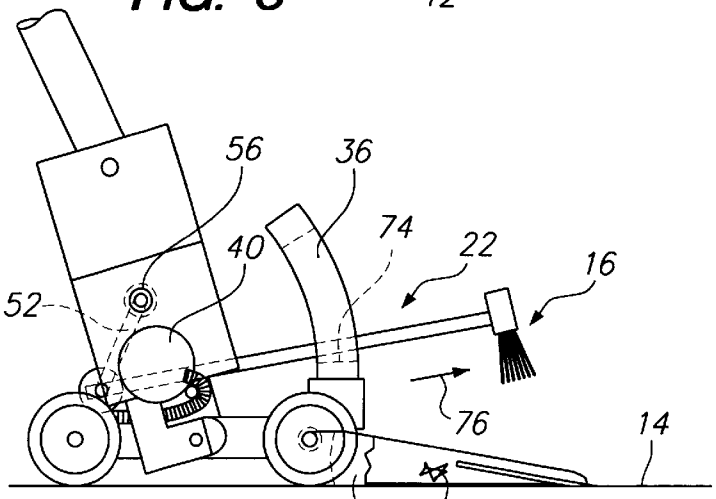
FIG. 5 is a partial side elevational view showing the sweeping action of the present invention in which the brush has begun its extension outwardly from the pan.
Figure 4:
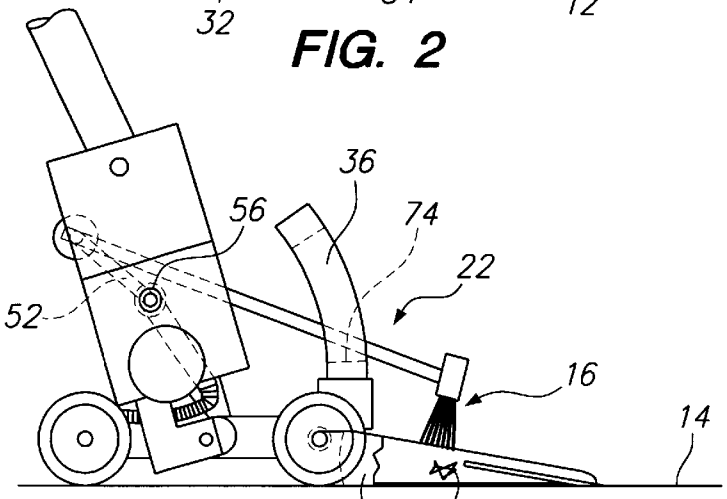
FIG. 4 is a partial side elevational view showing the sweeping action of the present invention in which the brush has completed its movement toward the pan and is beginning to lift from the pan.
Figure 6:
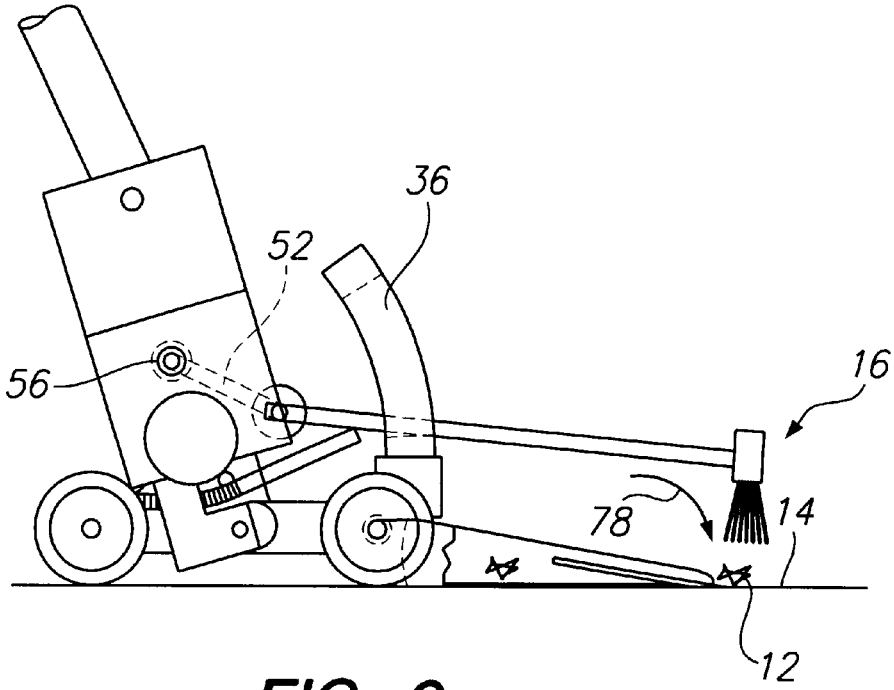
FIG. 6 is a partial side elevational view showing the sweeping action of the present invention in which the brush has extended outwardly to its fullest length and has begun its downward motion to the surface to begin another cycle as shown by FIG. 2.

In operation, referring again to FIGS. 2–6, the sweeping action of device 10 is indicated when shaft 56 is rotated according to directional arrow 72. FIG. 2 shows arm 22 in its fullest extension such that brush 16 is in contact with surface 14 and debris 12 lies between brush 16 and dustpan 34. FIG. 3 depicts crank 52 being turned and causing arm 22 to pull brush 16 toward pan 34 and onto pan 34 such that debris 12 is deposited on pan 34. Turning to FIG. 4, it may be observed that crank 52 has further turned about shaft 56 and in contact with floor 74 of slot 38. Floor 74 of slot 38 acts as a cam surface such that arm 22 slides along floor 74 and, consequently, lifts brush 16 from pan 34. FIG. 5 depicts further turning of crank 52 and further lifting of brush 16 as well as the beginning of a motion outwardly from motor 40 according to directional arrow 76. FIG. 6 depicts the turning of crank 52 to the point where it is in a position just prior to the depiction of crank 52 in FIG. 2. At this point, brush 16 is lowered downwardly toward debris 12 according to directional arrow 78. Referring again to FIG. 2, it may be seen that crank 52 in this figure also represents a beginning of the repeating of the cycle hereinabove described, such that arm 22 has lifted from floor 74 of slot 38 and again moves toward motor 40. Reversing the direction of shaft 54 by the use of switch 50 and reversing motor 40 would cause brush 16 to act in the opposite manner, pushing debris 12 away from pan 34 if desired. It should be understood that shaft 56 turns oppositely with respect to directional arrow 72 of FIG. 2, in such reverse mode.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A surface sweeping device, comprising:

a. a brush;

b. an arm having a first end portion and a second end portion, said first end portion connected to said brush;

c. a rotating shaft;

d. means for rotating said shaft;

e. a crank, said crank having a first portion connected to said rotating shaft for movement therewith, and a second portion rotatably connected to said second end portion of said arm and connected brush, to move said brush along the surface; and f. a cam surface, said arm contacting said cam surface during a portion of said rotation of said crank to raise said brush from the surface.

2. The device of claim 1 which further comprises a platform for supporting said motor.

3. The device of claim 2 in which said means for rotating said shaft comprises a motor.

4. The device of claim 2 which additionally comprises at least one wheel linked to said platform to permit said platform to roll along the surface.

5. The device of claim 2 in which said cam surface includes a flange extending from said platform said flange including a slot for accommodating said arm.

6. The device of claim 2 which further comprises a pan linked to said platform.

7. The device of claim 6 in which said means for rotating said shaft comprises a motor.

8. The device of claim 2 which further comprises a spring linked to said platform and said arm between connection of said arm to said crank and contact of said arm to said cam surface.

9. The device of claim 8 in which said means for rotating said shaft comprises a motor.

10. The device of claim 9 which additionally comprises at least one wheel linked to said platform to permit said platform to roll along the surface.

11. The device of claim 10 in which said cam surface includes a flange extending from said platform said flange including a slot for accommodating said arm.

12. The device of claim 11 which further comprises a pan linked to said platform.

13. The device of claim 12 in which said means for rotating said shaft comprises a motor.

14. The sweeping device of claim 1 in which said brush includes a first portion and a second portion pivotally connected to said first portion.

* * * * *